US005142951A

United States Patent [19]

Walton

[11] Patent Number: 5,142,951

[45] Date of Patent: Sep. 1, 1992

[54] TORQUE WRENCH

[75] Inventor: John N. Walton, Whitley Bay, England

[73] Assignee: Hedley Purvis Limited, Morpeth, England

[21] Appl. No.: 672,028

[22] Filed: Mar. 19, 1991

[30] Foreign Application Priority Data

Mar. 20, 1990 [GB] United Kingdom ..... 90062688

[51] Int. Cl.[5] ..... B25B 13/46

[52] U.S. Cl. ..... 81/57.39

[58] Field of Search ..... 81/57.39

[56] References Cited

U.S. PATENT DOCUMENTS 4,269,088 5/1981 Dukes ..... 81/57.39
4,385,533 5/1983 Collins ..... 81/57.39
4,429,597 2/1984 Grabovac et al. ..... 81/57.39
4,480,510 11/1984 Aparico, Jr. et al. .
4,513,645 4/1985 Grabovac et al. .

*Primary Examiner*—James G. Smith
*Attorney, Agent, or Firm*—Cushman, Darby & Cushman

[57] ABSTRACT

A torque wrench comprises an elongate body portion including a hydraulic piston-cylinder assembly and a drive mechanism actuated by the piston-cylinder assembly to rotate an associated component about a first axis extending perpendicular to the line of action of the assembly. A reaction member is mounted to the body portion to be pivotal relative thereto about a second axis extending parallel with the first axis between different positions extending angularly outwardly of the body portion.

7 Claims, 5 Drawing Sheets

TORQUE WRENCH

BACKGROUND TO THE INVENTION

This invention relates to torque wrenches and more particularly to such wrenches incorporating reaction members for engagement with a fixed component during the tightening or untightening procedure.

When torque tightening a nut or a bolt of a series of nuts and bolts using a torque wrench provided with a reaction member, whether an arm or a foot, the wrench can usually be positioned whereby the reaction member reacts from the nut or bolt to either side of the one being tightened—i.e. the wrench can be located either behind or in front of the row of nuts and bolts.

In certain circumstances, however, there may be restricted access either behind or in front of the row of nuts and bolts whereby a torque wrench can only be located in front of or behind said row. Such a situation can arise, for example, when attaching or removing the individual blades of a ship's propeller to the central hub, and when dealing with the individual blades of a turbine.

Thus it will be appreciated that, when the last bolt in a line of bolts is reached, there is no reaction point available to the torque wrench.

Attempts have been made to overcome this problem of restricted access by providing a torque wrench incorporating a pair of driving heads adapted to tighten two bolts simultaneously, each bolt being tightened also being reacted upon.

However, such a tool has a number of disadvantages. It is a complex, expensive piece of equipment that is dedicated to a particular use and cannot be used for tightening individual bolts. It cannot be used for an uneven number of bolts, while the actual load applied to a bolt may vary in each bolt being tightened, as maximum torque is applied to the tightest bolt. Further, such a wrench cannot cater for differing bolt pitches because of the fixed nature of the driving heads.

SUMMARY OF THE INVENTION

It is an object of the invention to provide a torque wrench of simple construction capable of accommodating restricted access to nuts and bolts to be tightened or unfastened thereby, and also capable of use under normal circumstances regardless of pitch variations in the nuts and bolts.

According to the present invention there is provided a torque wrench comprising an elongate body portion including a hydraulic piston-cylinder assembly, and a drive mechanism actuated by said assembly to rotate an associated component about a first axis extending perpendicular to the line of action of the piston-cylinder assembly, characterised by a reaction member mounted to the body portion to be pivotal relative thereto about a second axis extending parallel with the first axis between different positions extending angularly outwardly of the body portion.

Thus it will be appreciated that, in situations where access is restricted to one side of a series of nuts or bolts such that a torque wrench with a conventional reaction arm or foot could not be used to rotate one or more nuts or bolts of the series, the pivotal reaction member of the torque wrench of the invention can be maneuvered to ensure reaction against a suitable fixed component whereby said otherwise inaccessible nuts or bolts can be rotated.

The body portion may house therein a separate hydraulic piston-cylinder assembly or the body portion may comprise the cylinder of the hydraulic piston-cylinder assembly.

Preferably the reaction member includes, at or adjacent its free end remote from the pivotal mounting, a first socket adapted to locate over a first fixed component spaced from said component to be rotated.

The reaction member may further include, intermediate said first socket and said pivotal mounting, one or more further sockets adapted to locate over further fixed components between said first fixed component and the component to be rotated.

In one embodiment of the invention, the reaction member comprises first and second arm portions extending longitudinally of the body portion one to each side of the pivotal mounting, each arm portion including, at or adjacent its free end remote from the pivotal mounting, a socket, the reaction member being pivotal between a first position in which, in use, the socket at or adjacent the free end of the first arm portion is located over a fixed component and the socket at or adjacent the free end of the second arm portion is located over the component to be rotated, and a second position in which, in use, the socket at or adjacent the free end of the second arm portion is located over a fixed component and the socket at or adjacent the free end of the first arm portion is located over the component to be rotated.

The reaction arm may be mounted directly to the body portion and may comprise opposed, interconnected plates one to each side of the body portion and each including aligned sockets therein.

Alternatively, the torque wrench may include a reaction foot removably mounted on the body portion, the reaction member comprising an arm pivotally mounted on said reaction foot.

DESCRIPTIONS OF THE PREFERRED EMBODIMENTS

Figure 1:
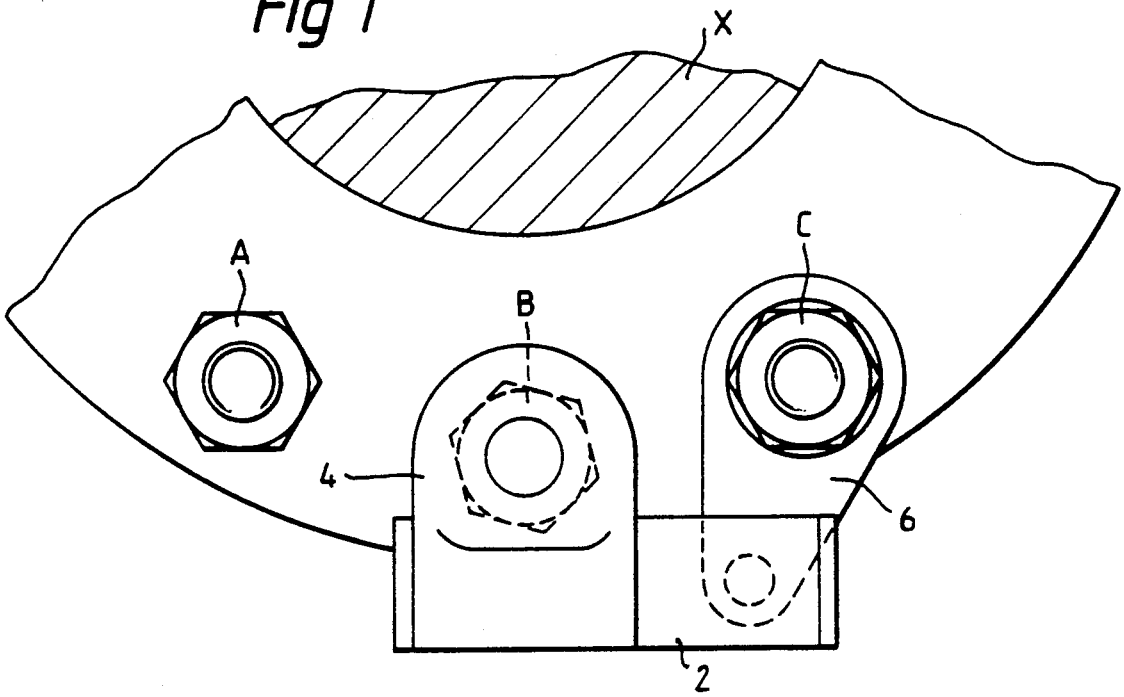
FIGS. 1 and 2 show a first torque wrench according to the invention tightening a first bolt and reacting against a bolt to one side and to the other side respectively of said first bolt.
Figure 2:
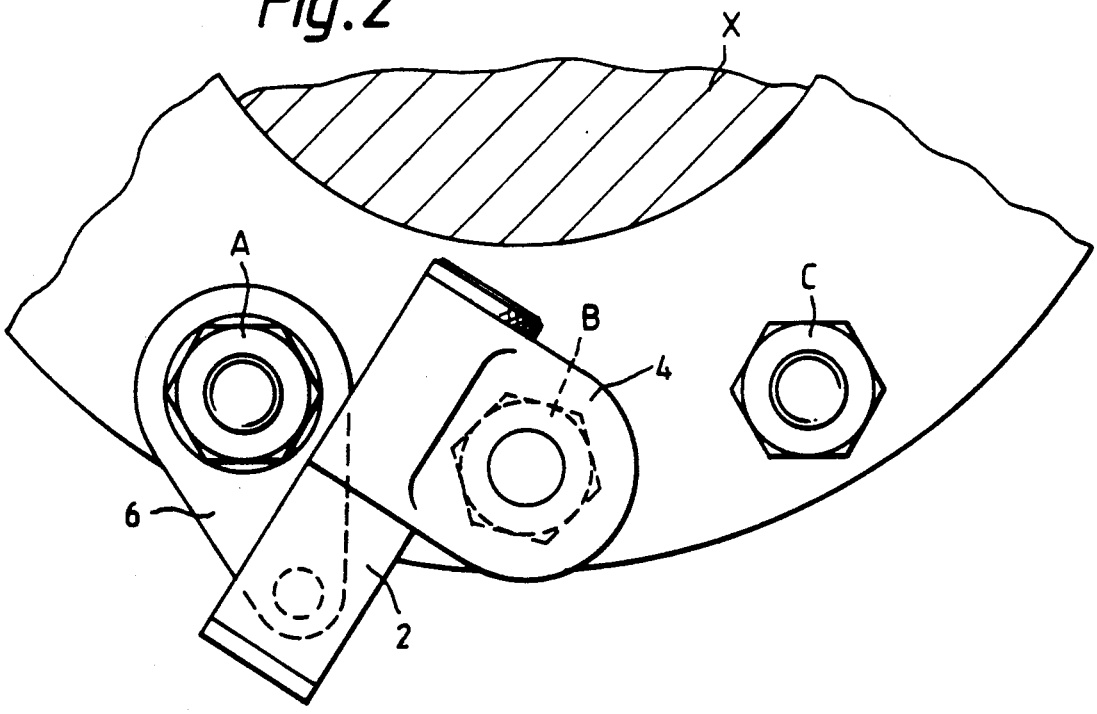

Referring to FIGS. 1 and 2 there is shown a torque wrench of relatively conventional construction and including a generally cylindrical body portion 2 housing a hydraulic piston-cylinder assembly.

To the front of the body portion 2 there is a housing 4 containing a drive mechanism which, in the case of a conventional wrench, comprises a pivotal drive lever carrying a square drive shaft and to which can be attached sockets of varying sizes, all in conventional manner.

Heretofore torque wrenches have been provided with reaction arms and/or reaction feet adapted to react against a fixed member, conveniently an adjacent nut or bolt head, during a tightening procedure. However, such reaction arms and/or feet, once mounted on the wrench, are fixed relative thereto and project therefrom in a given direction.

There are situations, as mentioned above, where the access to a row of bolts may be restricted to one side of the row and whereby the torque wrench, because of its physical size, cannot be positioned to that one side of the row. Consequently one or more of the bolts of the row may not be able to be tightened by the torque wrench because there is no suitably-positioned fixed member for the reaction member of the wrench to react against with the wrench positioned to the only side of the row of bolts available to it.

In FIGS. 1 and 2 there are shown three bolts A, B and C with access thereto restricted to the rear side thereof in the region referenced X.

With a conventional wrench having a fixed reaction arm projecting therefrom, bolt A can be tightened by positioning the wrench in front of the row and with the reaction arm reacting against bolt B.

Similarly, bolt B can be tightened by the conventional wrench with the reaction arm reacting against bolt C.

However, bolt C cannot be tightened because there is no abutment for the reaction arm of the wrench, since the wrench cannot be located to the rear of the row to utilise bolt B as a reaction point because of the restricted access indicated at X.

In order to overcome this problem, the wrench of the invention as shown in FIGS. 1 and 2 includes a reaction arm 6 which is pivotally mounted to the body portion 2 to be movable between angularly-displaced positions extending outwardly from the body portion 2 to each side thereof.

The resultant arrangement is such that any bolt can be tightened by reaction against an adjacent bolt to either side thereof without the necessity for the wrench to be located in the region of restricted access.

More particularly, and referring to FIG. 1, in order to tighten bolt B with a wrench according to the invention a suitable socket is attached to the square drive shaft of the wrench for location on the bolt B, while the free end of the pivotal reaction arm 6 incorporates a socket adapted to seat over the bolt C.

Thus, the socket on the drive shaft is positioned on bolt B and the reaction arm 6 is pivoted so that the socket therein overlies and can be positioned on bolt C. The wrench is then actuated to tighten bolt B with the reaction being absorbed by bolt C via reaction arm 6.

Bolt B can similarly be tightened by the wrench with reaction taking place against bolt A.

Referring to FIG. 2, the wrench is positioned as shown with the socket on the drive shaft again located on bolt B, but with the reaction arm 6 suitably pivoted relative to the body portion 2 so that the socket therein can be positioned on bolt A. Even in this position of the wrench, there is no impingement upon the region of restricted access at X.

Thus it will be appreciated that the pivotal nature of the reaction arm 2 enables endmost nuts or bolts to be tightened providing there is a suitable reaction point to one side only of the nut or bolt to be tightened and regardless of which side that reaction point is located.

Figure 3:
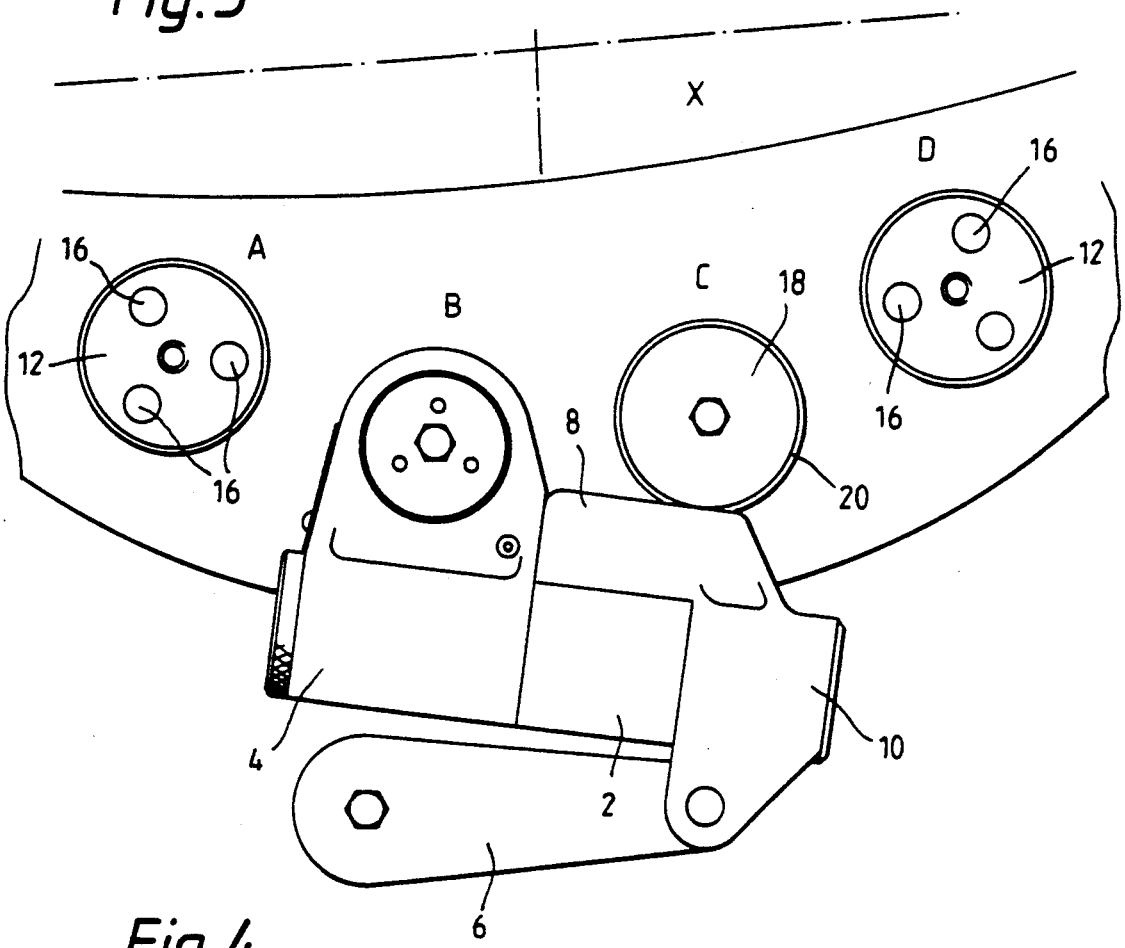
FIGS. 3 and 4 show a second torque wrench according to the invention and reacting against bolts to different sides of the bolt being tightened.
Figure 4:
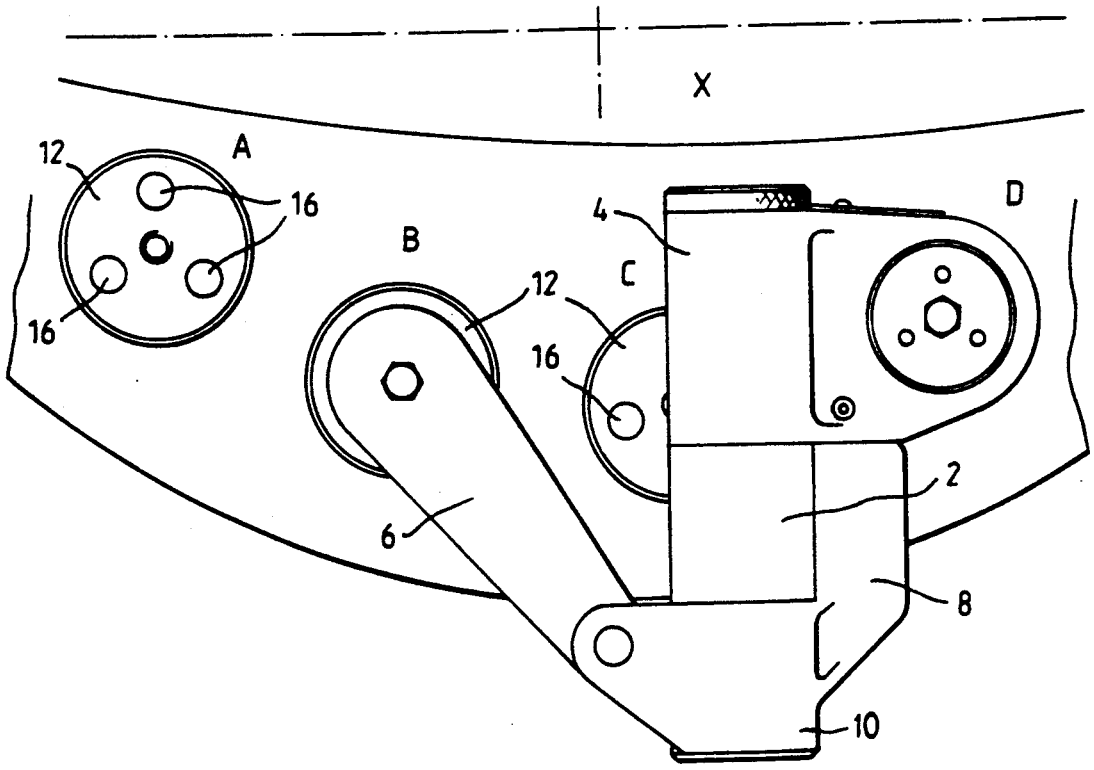

FIGS. 3 and 4 show an alternative torque wrench according to the invention which includes a reaction foot 8 mounted on the body portion 2, for example by means of a series of internal splines formed longitudinally of a hollow cylindrical bore through a member 10 carrying the reaction foot 8 and co-operating with a corresponding series of longitudinal splines formed along the body portion 2 of the wrench.

Pivotally mounted to the member 10 is a reaction arm 6 the free end of which is adapted to carry a socket as will be detailed below.

Four bolts A to D are shown in FIGS. 3 and 4 with access to these bolts restricted at the region X to one side of the row. The bolts include heads 12 which are sunk into the member 14 so that the upper faces thereof are substantially flush with the surface of the member 14.

Each bolt head 12 is provided with three uniformly-spaced bores 16 to receive therein corresponding pegs on an associated drive socket to be attached to the drive mechanism of the wrench.

The illustrated wrench is of the low profile type and includes a drive lever with a hexagonal socket therein. The drive socket includes a hexagonal shaft one end of which is received in said socket in the drive lever and the other end of which carries said axially-extending pegs.

Bolts A, B and C can be tightened by the wrench in its conventional mode by using the reaction foot 8. In FIG. 3, the drive socket is shown applied to the bolt B, while a peg reaction socket 18 similar to the drive socket and surrounded by a protective collar 20 is located on the head 12 of the bolt C for engagement by the reaction foot 8. The reaction arm 6 is not in use in this mode.

It will be appreciated that bolt A can be tightened with the reaction foot 8 reacting on bolt B, and bolt C can be tightened with the reaction foot 8 reacting on bolt D.

However, there is no convenient fixed reaction point available to the wrench when tightening bolt D in the conventional manner. This bolt D can be tightened as shown in FIG. 4.

A peg drive socket is again mounted on the drive mechanism of the wrench for location on the bolt D, while a peg reaction socket is mounted to the free end of the reaction arm 6 to extend perpendicularly therefrom. The reaction socket is located on bolt B with the wrench positioned as shown in FIG. 4 and the reaction arm 6 extending angularly outwardly therefrom. The reaction foot 8 is not in use in this mode.

Thus, because of the provision of the pivotal reaction arm 6, bolt D can be tightened by reaction against bolt B and without the wrench impinging upon the region X of restricted access.

Figure 5:
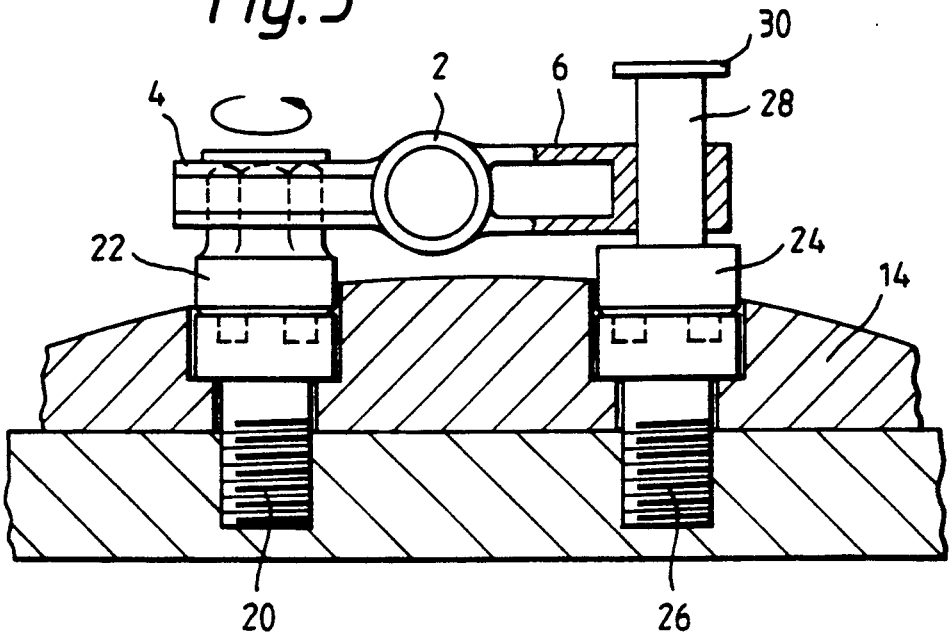
FIGS. 5 and 6 show a third torque wrench according to the invention capable of axial movement with a bolt being unfastened.
Figure 6:
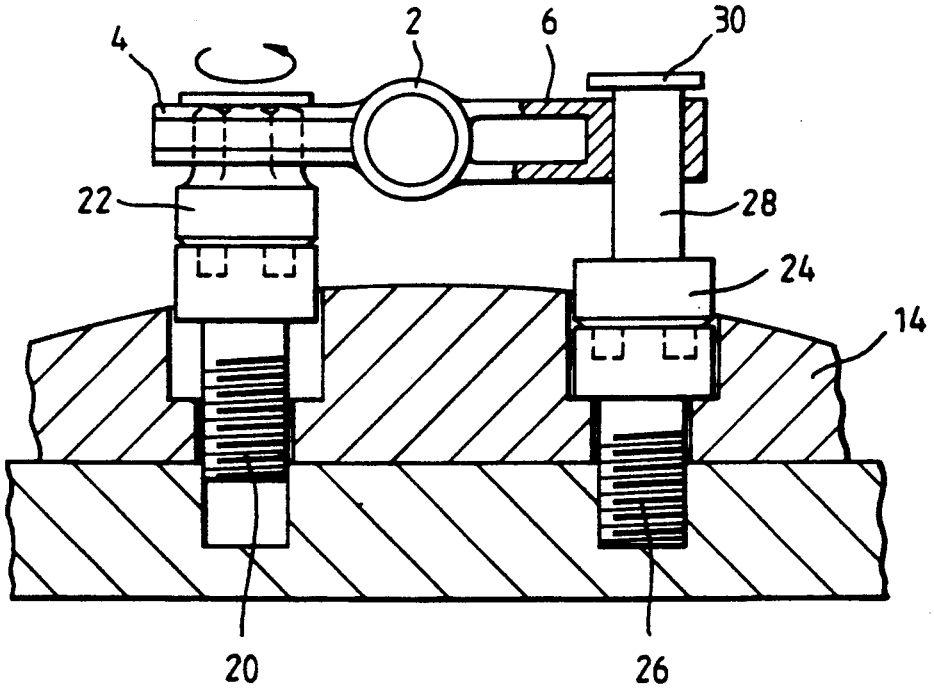

FIGS. 5 and 6 illustrate a low profile torque wrench according to the invention able to accommodate upward movement of a bolt on untightening thereof.

More particularly, the wrench is shown unfastening a bolt 20 by means of a peg drive socket 22 mounted to the drive mechanism of the wrench, with the pivotal reaction arm 6 carrying a peg reaction socket 24 located on a fixed bolt 26.

The reaction socket 24 includes an upstanding cylindrical shaft 28 which extends through a corresponding bore in the reaction arm 6 whereby the arm 6 can slide along said shaft 28 between extreme positions determined by abutment with the top of the socket 24 and with an increased-diameter stop 30 on the free end of the shaft 28.

Thus, as the bolt 20 is unscrewed and rises up relative to the fixed member 14, taking with it the wrench as shown in FIG. 6, the reaction arm 6 slides up the shaft 28 of the reaction socket. 24 and prevents any undesirable twisting of the wrench that would otherwise occur.

Figure 7:
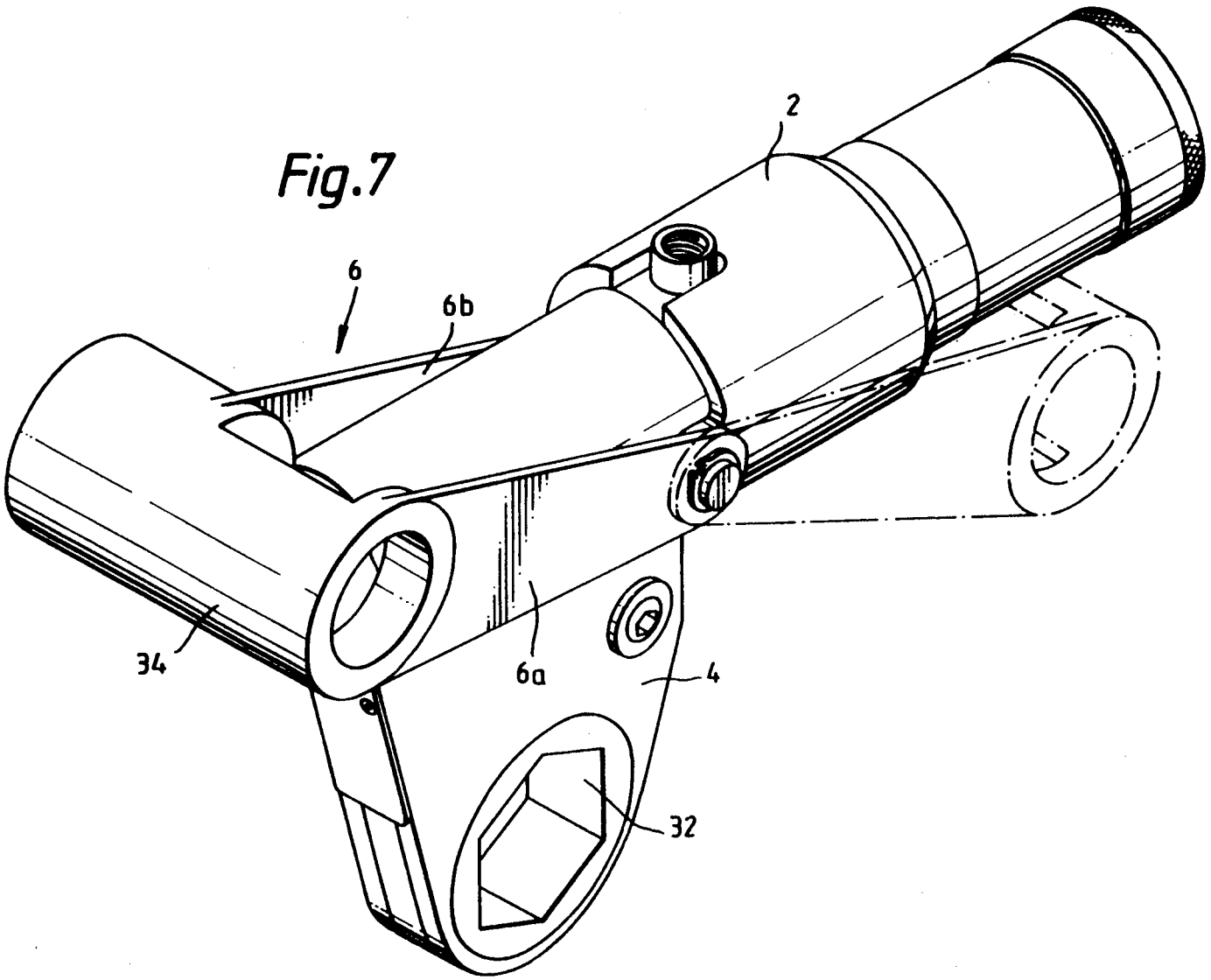
FIG. 7 shows a fourth torque wrench according to the invention with a modified reaction member.

FIG. 7 illustrates a low profile torque wrench according to the invention in which the reaction arm is so arranged as to eliminate the requirement of a reaction foot.

More particularly, the wrench includes a housing 4 containing a pivotal drive lever in which is formed a hexagonal socket 32, the reaction arm 6 being mounted to the body portion 2 to be pivotal about an axis extending parallel with the axis of rotation of the socket 32.

The reaction arm 6 includes a pair of opposed plates 6*a*, 6*b*, one to each side of the wrench, the free ends of the arms 6*a*, 6*b* carrying a cylindrical socket 34.

The configuration of the reaction arm 6 is such that it can pivot from the position shown in dotted lines in FIG. 7, just below the body portion 2, over the housing 4 to the position shown in full lines in FIG. 7 and thence, if required, to a position just above the body portion 2 with the socket 34 abutting the rear regions of the body portion 2 remote from the housing 4. Clearly such extensive angular movement of the reaction arm 6, together with the ability of the socket 34 to receive in either end thereof a fixed component enables this low profile wrench to react to either side of a bolt being tightened or slackened.

Figure 8:
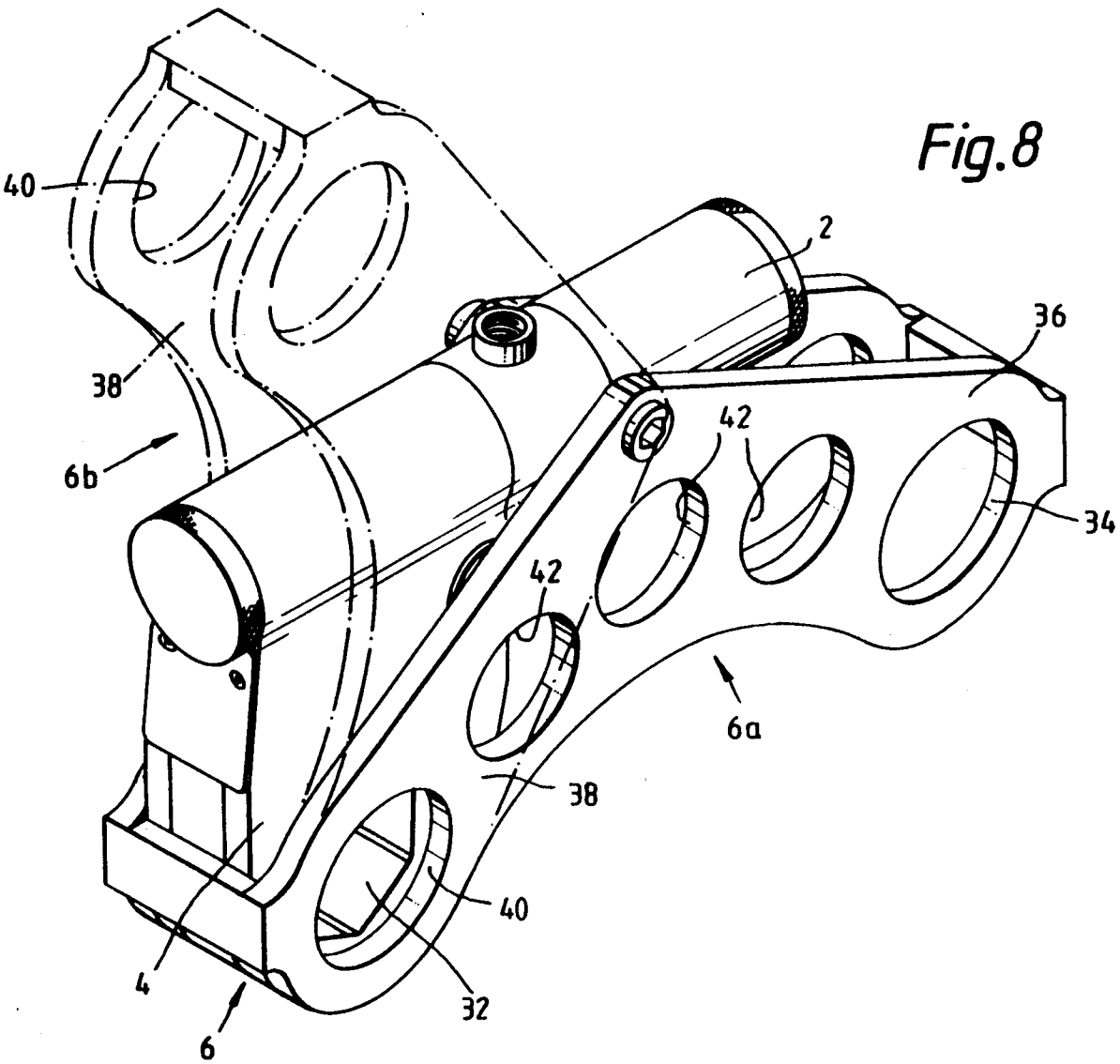
FIG. 8 shows a fifth torque wrench according to the invention with a further modified reaction member.

Referring to FIG. 8 there is illustrated a development of the low profile torque wrench shown in FIG. 7 in which the reaction arm 6 again comprises opposed, interconnected plates 6*a*, 6*b* one to each side of the wrench. Each plate 6*a*, 6*b* includes a first arm portion 36, as in the embodiment of FIG. 7, together with a second arm portion 38 integral with the arm portion 36 and extending axially of the body portion 2 to the other side of the pivotal mounting of the reaction arm 6. The arm portions 38 are substantially mirror images of the associated arm portions 36, each portion 36 including a cylindrical socket 34 adjacent its free end and each portion 38 including a cylindrical socket 40 adjacent its free end.

The arrangement is such that, in a first operative position of the torque wrench, the socket 34 locates over the fixed reaction component spaced to one side of the nut or bolt to be tightened, while the socket 40 locates over the socket actually used to tighten the nut or bolt in question. Thus it will be appreciated that the provision of the socket 40 provides additional restraint for absorbing reaction forces.

If the wrench is to react against a fixed component to the other side of the nut or bolt to be tightened, the reaction arm 6 is pivoted to the second operative position shown in FIG. 8 in which the socket 34 locates over the component to be tightened, while the socket 40 locates over the fixed component to the other side of the nut or bolt to be tightened.

The reaction arm 6 shown in FIG. 8 is, provided with additional apertures or sockets 42 disposed therein intermediate the sockets 34 and 40 which may be of different sizes. These additional sockets 42 can be located over additional or other fixed components thereby increasing the versatility of the tool and enabling different bolt pitches and/or different bolt sizes to be accommodated by a single tool.

Clearly the reaction arms 6 shown in the other drawings could also include additional sockets such as those shown at 42 in FIG. 8.

Thus there are provided torque wrenches of relatively simple construction which are capable of accommodating restricted access to nuts and bolts to be tightened or slackened but which can also be used in conventional situations for all pitch variations in the nuts and bolts.

The precise construction of the torque wrench, the drive and reaction sockets associated therewith and the precise mode of operation, can vary from those described and illustrated without departing from the scope of the basic invention which requires the provision of a pivotal reaction arm associated with the wrench.

I claim:

1. A torque wrench for rotating a component about a first axis, the torque wrench comprising:

an elongate body portion, a hydraulic piston-cylinder assembly included in said body portion and having a line of action perpendicular to said first axis, a drive mechanism actuated by said assembly to rotate an associated component about said first axis, and a reaction member mounted to the body portion to be pivotal relative thereto about a second axis extending parallel with the first axis between different positions extending angularly outwardly of the body portion, the reaction member comprising first and second arm portions extending longitudinally of the body portion one to each side of the second axis, each arm portion having a free end remote from the second axis and including, adjacent its free end, a socket, the reaction member being pivotal between a first position in which, in use, the socket adjacent the free end of the first arm portion is located over a fixed component and the socket adjacent the free end of the second arm portion is located over the component to be rotated, and a second position in which, in use, the socket adjacent the free end of the second arm portion is located over a fixed component and the socket adjacent the free end of the first arm portion is located over the component to be rotated.

2. A torque wrench as claimed in claim 1 wherein said hydraulic piston-cylinder assembly is housed separately within the body portion.

3. A torque wrench as claimed in claim 1 wherein the body portion comprises the cylinder of the hydraulic piston-cylinder assembly.

4. A torque wrench as claimed in claim 1 and including a reaction foot removably mounted on the body portion, the reaction member comprising an arm pivotally mounted on said reaction foot.

5. A torque wrench as claimed in claim 1, wherein at least one of the arm portions of the reaction member further includes, intermediate the socket adjacent its free end and the second axis, at least one further socket adapted to locate over fixed components.

6. A torque wrench as claimed in claim 1 wherein the reaction member is mounted directly to the body portion.

7. A torque wrench as claimed in claim 1 wherein the reaction member comprises opposed, interconnected plates one to each side of the body portion, each plate including aligned sockets therein.

* * * * *